US009255422B1

(12) United States Patent
Wagner et al.

(10) Patent No.: US 9,255,422 B1
(45) Date of Patent: Feb. 9, 2016

(54) LEAD AND PARTICULATE ABATEMENT SYSTEM

(76) Inventors: William E. Wagner, Washingtonville, NY (US); Adam J. Ferstand, Middletown, NY (US)

( * ) Notice: Subject to any disclaimer, the term of this patent is extended or adjusted under 35 U.S.C. 154(b) by 418 days.

(21) Appl. No.: 13/433,122

(22) Filed: Mar. 28, 2012

Related U.S. Application Data

(60) Provisional application No. 61/468,394, filed on Mar. 28, 2011, provisional application No. 61/562,298, filed on Nov. 21, 2011.

(51) Int. Cl.

| | |
|---|---|
| ***E04H 15/14*** | (2006.01) |
| ***E04H 9/06*** | (2006.01) |
| ***E04G 21/24*** | (2006.01) |
| ***E04H 15/46*** | (2006.01) |

(52) U.S. Cl.
CPC ..... *E04H 15/14* (2013.01); *E04G 21/24* (2013.01); *E04H 9/06* (2013.01); *E04H 15/46* (2013.01)

(58) Field of Classification Search
CPC ..... B08B 15/00; B08B 15/02; B08B 15/026; E04H 1/1205; E04H 15/42; E04H 15/46; E04H 1/02; E04H 9/06; E04H 15/14; E04H 1/1277; E04G 21/24; E04G 15/00; E06B 9/06; E06B 9/24
USPC ..... 135/141–142, 114, 115, 156, 900, 905, 135/93, 95–96, 117, 119; 52/79.1, 63, 202, 52/2.17; 454/63, 189, 192, 193; 55/385.2, 55/358.4, 385.7, 356; 248/354.6, 200.1, 248/188.2, 188.8, 188.9
See application file for complete search history.

(56) References Cited

U.S. PATENT DOCUMENTS

| | | | | |
|---|---|---|---|---|
| 4,682,448 | A * | 7/1987 | Healey | 52/63 |
| 4,706,551 | A * | 11/1987 | Schofield | 454/66 |
| 4,765,352 | A * | 8/1988 | Strieter | 134/99.1 |
| 4,786,296 | A | 11/1988 | Griffis | |
| 4,800,908 | A | 1/1989 | Lyons | |
| 4,817,644 | A | 4/1989 | Holmes et al. | |
| 4,853,042 | A | 8/1989 | Widerman, Jr. | |
| 4,857,085 | A | 8/1989 | Egri, II | |
| 5,004,483 | A | 4/1991 | Eller et al. | |
| 5,062,871 | A * | 11/1991 | Lemon, III | 55/385.2 |
| 5,080,701 | A | 1/1992 | Howard et al. | |
| 5,131,934 | A | 7/1992 | Patel | |
| 5,332,095 | A * | 7/1994 | Wu | 206/524.8 |
| 5,685,112 | A * | 11/1997 | Fara | 52/202 |
| 5,924,469 | A * | 7/1999 | Whittemore | 160/368.1 |
| 7,188,636 | B1 * | 3/2007 | Kanne et al. | 135/142 |

(Continued)

*Primary Examiner* — Winnie Yip
(74) *Attorney, Agent, or Firm* — Calhelha & Doyle, LLC

(57) ABSTRACT

An encapsulating system for abating and mitigating contamination from lead-based dust, particles and/or chips in a construction repair, renovation or removal operation and thereby minimizing exposure to lead-based hazardous materials is provided. The apparatus utilizes a framing mechanism supporting an encapsulator container or workbag adapted to surround and seal off a work-area encompassing a contaminated work-piece. The framing mechanism is typically adjustable poles or an adjustable frame apparatus having a plurality of height adjustable vertical legs. The flexible plastic encapsulating container is positioned and supported by the adjustable poles or frame. The container has at least one open-end for surrounding the contaminated work-piece, and the open-end of the container is adhered to the work-area and substantially surrounds and seals off the contaminated work-piece from the interior portions of the work site.

12 Claims, 13 Drawing Sheets

(56) References Cited

U.S. PATENT DOCUMENTS 8,397,958 B2 * 3/2013 Smith et al. ..... 222/494
8,590,229 B2 * 11/2013 Taylor et al. ..... 52/205
2004/0050008 A1 * 3/2004 Mintie et al. ..... 52/646
2009/0032204 A1 * 2/2009 Mintie et al. ..... 160/184
2010/0058674 A1 * 3/2010 Proctor et al. ..... 52/79.1

* cited by examiner

A-B-C Window Casings
a-b-c Separate Encapsulators
a'.b'.c' "Relatively clean" passageways

LEAD AND PARTICULATE ABATEMENT SYSTEM

CROSS-REFERENCE TO RELATED APPLICATIONS

This application claims the benefit of provisional application Ser. No. 61/468,394 filed Mar. 28, 2011 and Ser. No. 61/562,298 filed Nov. 21, 2011 which are both incorporated herein by reference.

FIELD OF THE INVENTION

The present invention relates to a safe lead and/or particulate mitigation and clean-up system.

BACKGROUND OF THE INVENTION

In building reconstruction and remodeling, contractors often encounter building components, particularly window and door casings and framing which may contain lead paint and/or other noxious and unsafe materials.

Good practices, as well as an increasing number of federal and municipal regulations, require safe clean-up procedures for the protection of the workers, as well as the environment, during restoration, repair, renovation and removal operations.

Lead exposure is known as a hazard to young children and babies. Even children who seem healthy can have high levels of lead in their bodies from exposure to contaminated materials. Lead can be absorbed in the body by breathing or swallowing lead dust, or by eating soil or paint chips containing lead. In most cases, lead-based paint that is in good condition is not a hazard, but this does not ordinarily remain the case during renovations.

Breathing lead dust, especially during renovations that disturb painted surfaces, is particularly hazardous and must be avoided to minimize dangerous levels of absorption. Lead exposure is more dangerous and acute when children are involved, as babies and young children will often put their hands and other objects in their mouths. Any of these objects can have lead dust on them. Furthermore, children's brains and nervous systems are more sensitive to the damaging effects of lead.

Lead from paint chips, which can sometimes be seen, and lead dust, which often cannot be seen, are both serious hazards. Peeling, chipping, chalking, or cracking lead-based paint are other sources of hazardous exposure and require immediate remediation.

Surfaces which experience a lot of wear-and-tear often cause lead hazards to accumulate and include windows and window sills, doors and door frames, stairs, railings, banisters, porches and fences. Lead dust can form when lead-based paint is dry scraped, dry sanded, or heated. Dust also forms when painted surfaces rub together. Lead chips and dust can get on surfaces and objects that people touch. Settled lead dust can re-enter the air when people vacuum, sweep or walk through it.

Removing lead-based paint improperly can increase the dangers of exposure to lead and lead dust. To permanently remove lead hazards, a trained and certified lead abatement contractor must be utilized. Abatement (or permanent hazard elimination) methods include removing, sealing, or enclosing lead-based paint with special materials. Painting over the hazard with regular paint is not sufficient, particularly during renovations which may require wholesale removal of large portions of building structures.

As of Apr. 22, 2010, federal law requires that renovation firms must be certified under the Environmental Protection Agency's Renovation, Repair and Painting Rule. Individuals must be trained in lead-safe work practices and training providers must be accredited by the EPA. Additional information is available from the U.S. Environmental Protection Agency at http://www.epa.gov/opptintr/lead/index.html.

Numerous abatement and mitigation systems have been previously developed as may be seen in the U.S. Patent Publications submitted herewith which are each incorporated herein by reference, including, U.S. Pat. No. 4,786,296, U.S. Pat. No. 4,817,644, U.S. Pat. No. 4,853,042, U.S. Pat. No. 4,857,085, U.S. Pat. No. 5,004,483, U.S. Pat. No. 5,080,701, and U.S. Pat. No. 5,131,934.

It will be recognized, however, that the prior systems each exhibit deficiencies in effectiveness, convenience, adaptability and expense. These features and others are addressed and improved by the present system and method.

SUMMARY OF THE INVENTION

All of the foregoing areas can be improved with the subject encapsulator design which utilizes a portable, adjustable, durable and flexible thermoplastic film barrier, preferably in the form of a large encapsulating pouch or workbag. The encapsulator workbag has its open end affixed to the area around a contaminated work-piece or work-area requiring repair, removal or renovation, and which effectively captures and encapsulates lead and particulate dust during removal and mitigation operations. In one embodiment, the encapsulator system may incorporate a portable, adjustable frame apparatus configured to deploy an open encapsulator workbag at and around a work area requiring dust abatement. "Frame" is used broadly as the mechanism to facilitate deployment of the workbag by any means necessary to hold it in place during remediation, whereupon the contaminated workbag is removed upon completion of the renovation task. The frame may be configured with poles, scaffolding, a skeleton structure, a disposable platform and other convenient designs.

An encapsulating system for abating and mitigating contamination from lead-based dust, particles and/or chips in a construction repair, renovation or removal operation and thereby minimizing exposure to lead-based hazardous materials is provided. In another embodiment, the apparatus may comprise an adjustable frame apparatus having a plurality of height adjustable vertical poles or legs. In this frame embodiment, the legs support a plurality of overhead horizontal frame members, the frame apparatus being adapted to surround a work-area encompassing a contaminated work-piece; a flexible plastic encapsulating container positioned within and supported by the adjustable frame apparatus. The container has at least one open-end for surrounding the contaminated work-piece, and the open-end of the container is adhered to the work-area and substantially surrounds the contaminated work-piece. As described below and in the accompanying figures, the apparatus and system are effective for enclosing and containing hazardous lead-based materials during a construction repair, renovation or removal operation. The method is complete upon safe, clean disposal of the encapsulator container and contaminants therein.

The encapsulating pouch or workbag may further comprise adhesive materials surrounding the open-end of the container; attachment fixtures for maintaining the flexible container by and within the adjustable frame; at least one entry/exit port separate from the open-end of the container and adapted to allow movement of an operator there through (and further comprising means such as a zipper for opening, closing and maintaining a seal). In typical embodiments, the opening of the workbag may be sealed around the work-piece with painter's adhesive tape.

A useful optional accessory would be at least one filter device for dust-free removal of air to facilitate collapsing the flexible container when the mitigation project is complete; as well as at least one air-entry filter to facilitate maintenance of the flexible container shape during use and for providing fresh air to a user deployed therein.

An alternative embodiment of the encapsulator apparatus is comprised of a plurality of height adjustable vertical legs or poles which use friction against the ceiling and floor of the work area to stand in place and to maintain the flexible plastic encapsulating container in an open position. Similarly, spring clamps or ties may be used at either end of the adjustable legs to affix the encapsulating container. Spring poles, telescoping poles and cut-to-size poles may all be utilized.

Other objects, features and advantages of the present invention will be apparent when the detailed descriptions of the preferred embodiments of the invention are considered with reference to the accompanying drawings, which should be construed in an illustrative and not limiting sense as follows:

DETAILED DESCRIPTION OF THE PREFERRED EMBODIMENTS

The proposed design is comprised of several parts which cooperate together for the purpose of collecting lead particles, chips, dust and other contaminants in reconstruction or restoration operations and minimizing exposure such hazardous materials.

Figure 1:
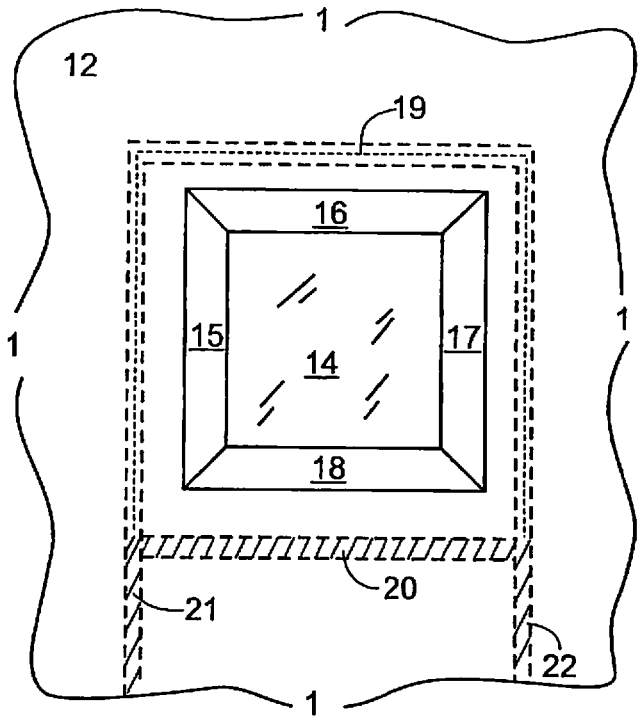
FIG. 1 is a schematic plan view of a window installation requiring lead abatement.

FIG. 1 depicts a schematic plan view of a window installation 1 requiring lead abatement. In FIG. 1, wall portion 12 has window 14 installed therein. Window 14 is encased in window frame members 15, 16, 17 and 18, which in this example have been previously painted with lead-based paint which now requires repair or removal. The encapsulator system and apparatus which is shown and described in the following Figures will be attached or preferably adhered to at least horizontal adhesive area 19, and may be additionally adhered to adhesive area 20 in the case of a window frame or casing restoration or repair, or also adhered to vertical adhesive areas 21 and 22 in the case of a door frame restoration or repair. Conventional painter's tape can be used for this purpose.

Figure 2:
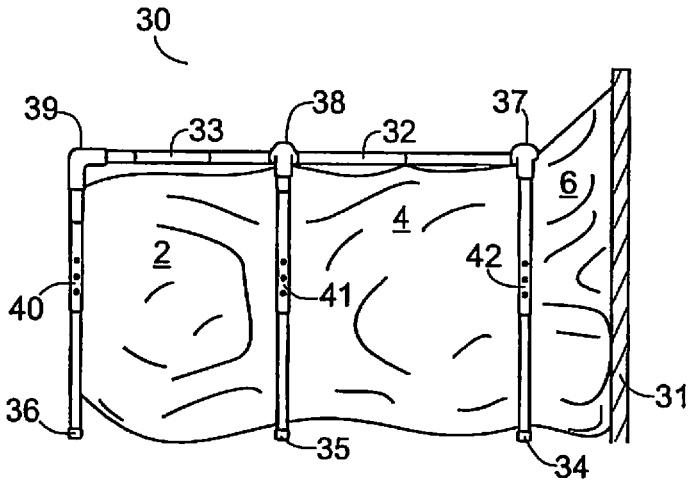
FIG. 2 is a side elevation view of the encapsulator apparatus of the present invention.

FIG. 2 depicts a side elevation view of the encapsulator apparatus 30 of the present invention. In this Figure, adjustable vertical legs 40, 41 and 42 are respectively joined to elbow junctions 39, 38 and 37 to support upper horizontal frame members 33 and 32. Fittings 36, 35 and 34 support the vertical legs. In this Figure, it can be seen that the adjustable frame members contain and support a flexible plastic containment device, preferably a workbag or bladder for holding lead dust and particles, having rear section 2, central section 4 and forward open section 6 to be adhered around and near the work piece located on or in wall section 31, to receive contaminated lead chips, particles and dust during a repair, renovation or removal project.

Figure 3:
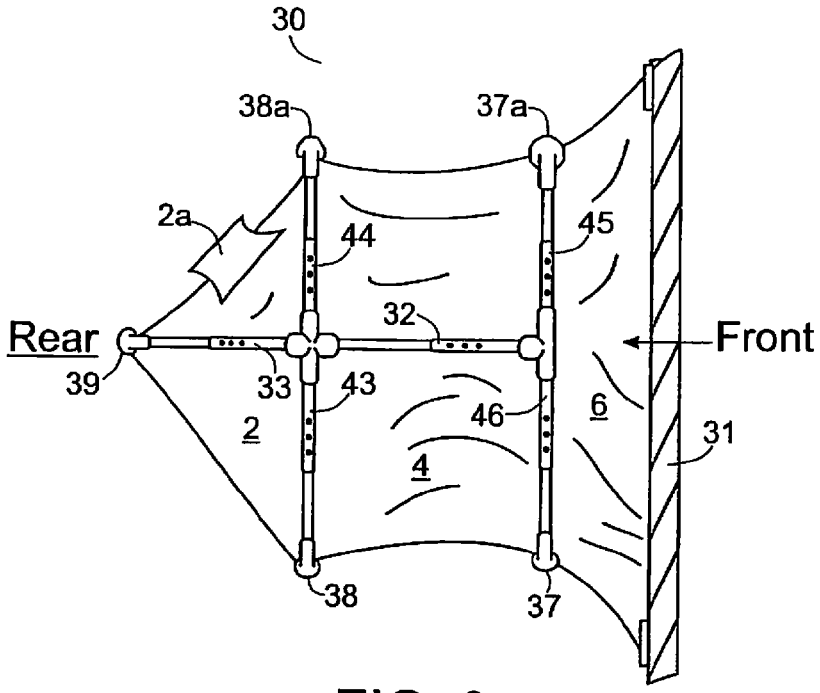
FIG. 3 is a top plan view of the apparatus of FIG. 2.

FIG. 3 depicts a top plan view of the apparatus 30 of FIG. 2. In this view, the flexible encapsulator container having rear section 2, center section 4 and front section 6 can be seen with and supported by the encapsulator frame apparatus. In this view, elbow joints 38 and 38*a* can be seen as connected via adjustable frame members 43 and 44 and cross joint 38*b*. Also seen in this view is a parallel portion of the frame apparatus consisting of elbow joints 37 and 37*a* which are connected via adjustable frame members 45 and 46 and t-joint 37*b*. Front flexible section 6 is seen adhered to work-area wall section 31 at the front of the apparatus. Also in this view, optional port 2*a* is seen which may be a filter, air supply or entry/exit portal. In many embodiments, an optional zipper may be installed for entry and exit.

Figure 4:
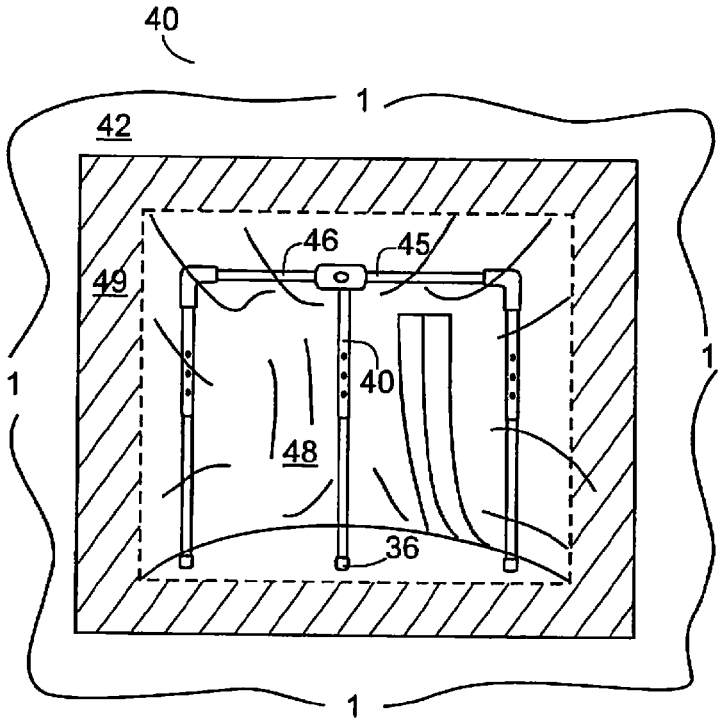
FIG. 4 is a front elevation view into an encapsulator apparatus, seen from outside a window installation.

FIG. 4 is a front elevation view into an encapsulator apparatus 40, seen from outside a window installation 1, that is looking into wall portion 42 which has on its inside surface adhesive area 49 surrounding the work-piece to be repaired or removed. Adjustable frame members 45, 46 and adjustable legs 40 support the flexible film container 48 throughout the remediation procedure.

Figure 5:
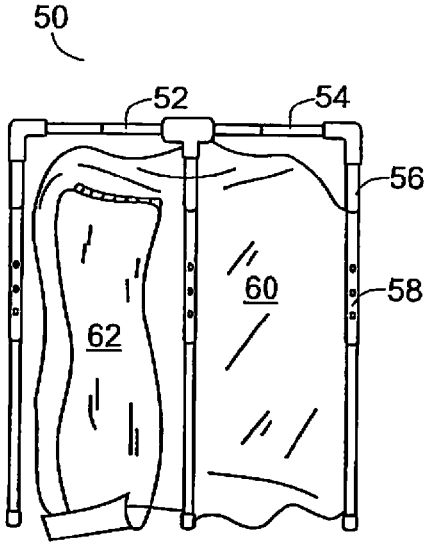
FIG. 5 is a rear elevation view of an alternative encapsulator apparatus having a rear entry/exit panel.

FIG. 5 is a rear elevation view of an alternative encapsulator apparatus 50, having frame members 52, 54, 56 and 58 and having a rear entry/exit panel 62 installed in the rear section of flexible film container 60.

Figure 6:
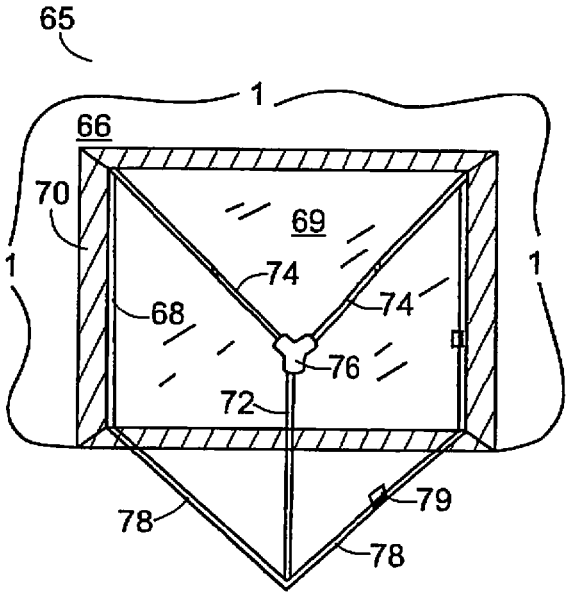
FIG. 6 is a perspective view of an alternative encapsulator apparatus.

FIG. 6 is a perspective view of an alternative encapsulator apparatus 65 depicted installed on wall section 66 surrounding window 69 and attached with adhesive to surrounding areas 70. The adjustable encapsulator frame members are 68, 72, 74, 76, 78 and 79. This embodiment may be suitable for smaller renovation projects.

Figure 7:
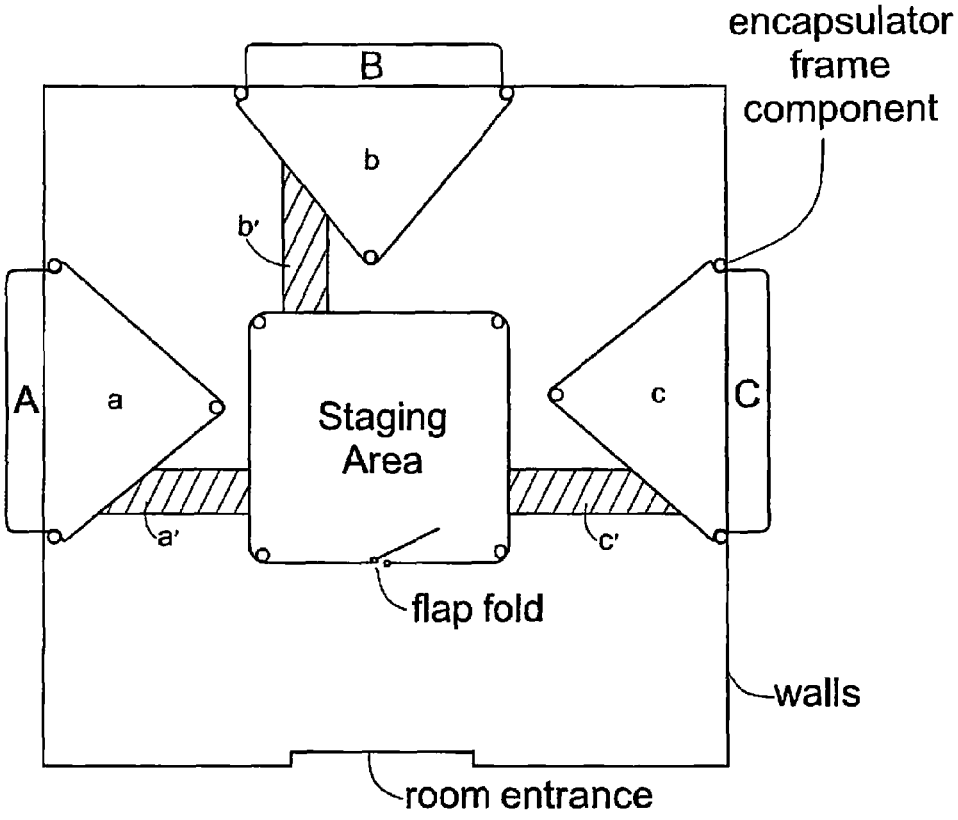
FIG. 7 is an alternate embodiment of the subject design providing multiple encapsulator chambers.

FIG. 7 is an alternate embodiment of the subject design providing multiple encapsulator chambers. Under appropriate circumstances, an entire room area can be remediated with the equipment and method of the subject invention. In this depiction, each of three independent window work-pieces A, B and C can accommodate respective work areas a, b and c for collecting lead, dust and other hazardous materials from each work piece. A relatively clean central staging area can coordinate activities for each work piece which can be reached via clean-passageways a', b' and c'. The staging area can have its own entry, in this case a flap fold to facilitate keeping the remainder of the room clean and contaminant free.

Figure 8:
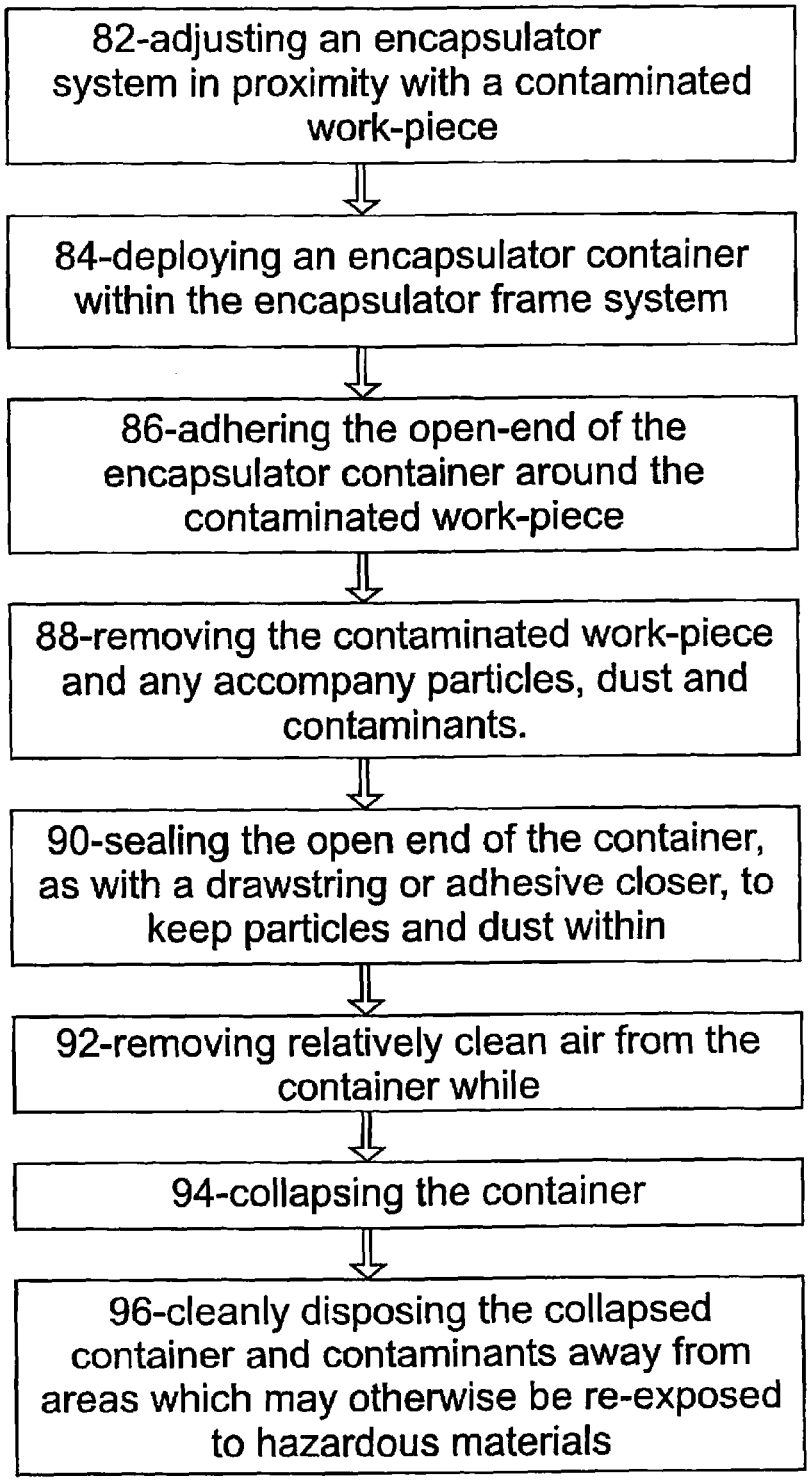
FIG. 8 is process flow chart depicting the subject system and method.

FIG. 8 is process flow chart depicting the subject system and method. The method comprises the steps of: first, adjusting an encapsulator system in proximity with a contaminated work-piece (82), this is typically accomplished with an adjustable or fixed pole or frame; deploying an encapsulator container (i.e. flexible workbag) within the encapsulator pole or frame system (84); adhering the open-end of the encapsulator container around the contaminated work-piece (86); removing the contaminated work-piece and any accompanying lead particles, dust and contaminants (88); sealing the open end of the container (as with a drawstring, tape, string or adhesive closer), to keep particles and dust within (90); removing relatively clean air from the container (92) while collapsing the container (94); and finally, cleanly disposing the collapsed container and contaminants away from areas which may otherwise be re-exposed to hazardous materials (96). A similar method would permit removal of a large volume of air through the fenestration, followed by sealing and removal of the contaminated container.

Figure 9:
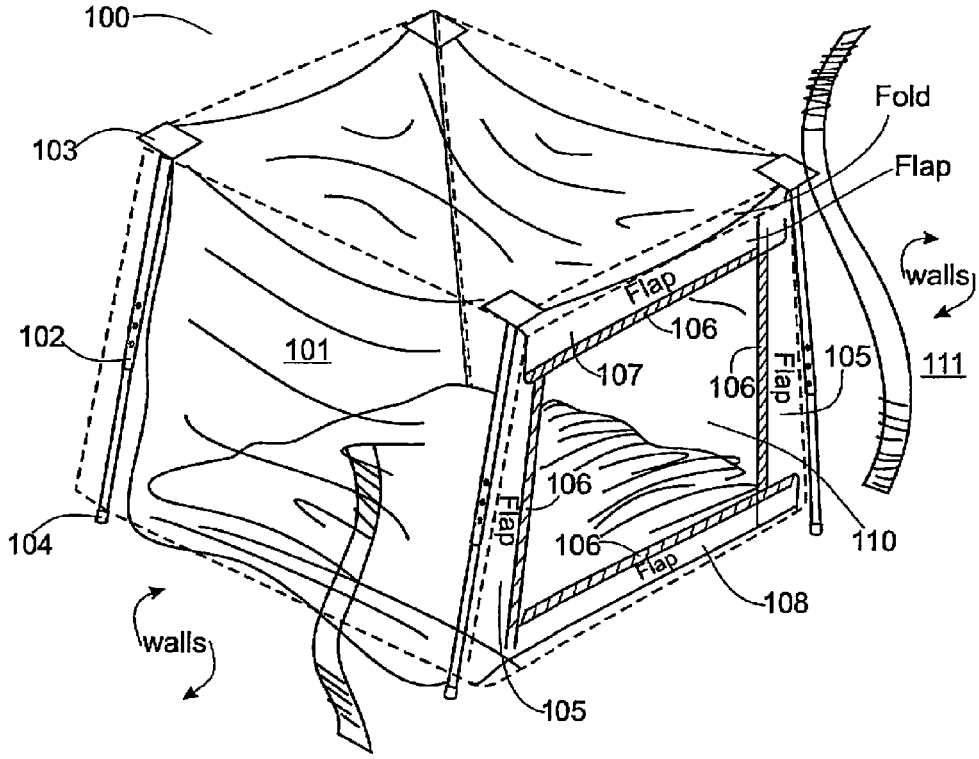
FIG. 9 is a perspective view of an alternative encapsulator apparatus.

FIG. 9 is an alternative embodiment 100 of the subject apparatus using only the adjustable height vertical legs 102 as support for the flexible film encapsulator workbag or bladder 101. The adjustable height vertical legs may be adjustable using any means of varying the length of a structural member, including spring loaded, or held in place using friction, screws or pins. The vertical leg has a base 104 for supporting the leg while it stands, and a top plate 103 for holding the encapsulator film 101 against the ceiling of the work area. In this embodiment, the encapsulator film 101 has opening 110 which would be directed towards the area requiring abatement. The side flaps 105 would be folded inwards, and top flap 107 and bottom flap 108 would be folded down and up respectively, so that tape areas 106 may be secured against the wall 111 surrounding the work area. Alternative embodiments deploy the adjustable poles in place directly between the ceiling and floor and thereafter secure the encapsulator film container thereto with spring clamps, ties and the like.

Figure 10:
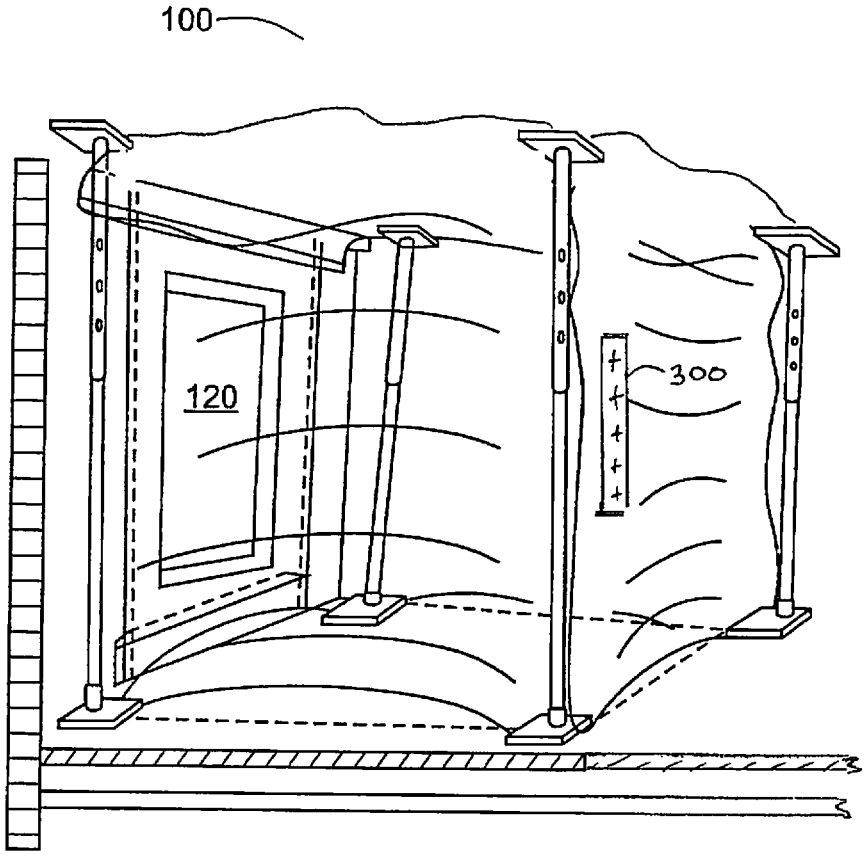
FIG. 10 is a perspective view of the apparatus of FIG. 9 as deployed for a window installation.

FIG. 10 shows the alternative embodiment 100 of the subject apparatus of FIG. 9 as deployed in a work area surrounding a window 120. The encapsulator container opening is preferably sealed around the window work area with pressure-sensitive adhesive or tape. This figure additionally depicts use of zipper entry 300 in one side wall of the container.

Figure 11A:
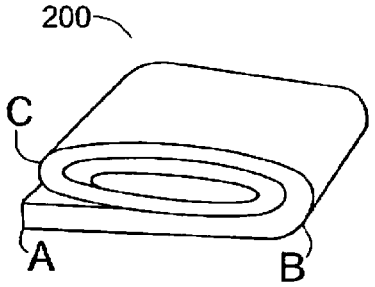
FIGS. 11*a-g* is a diagram showing the method of unfolding the apparatus of FIG. 9.
Figure 11B:
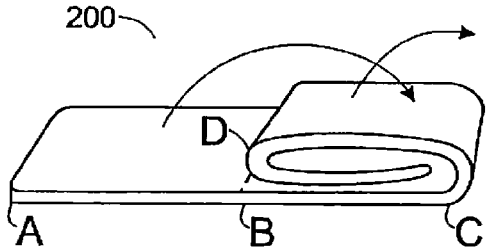
Figure 11C:
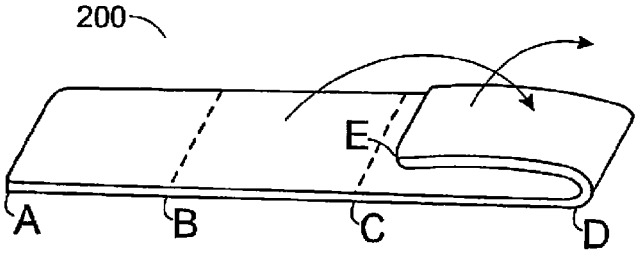
Figure 11D:
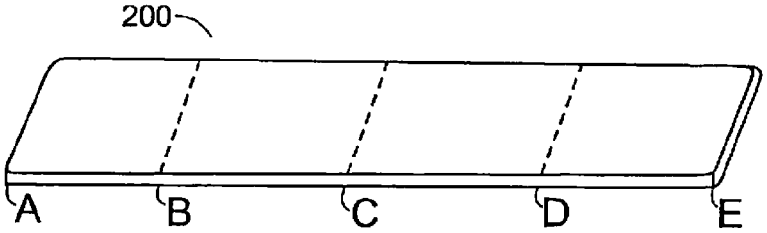
Figure 11E:
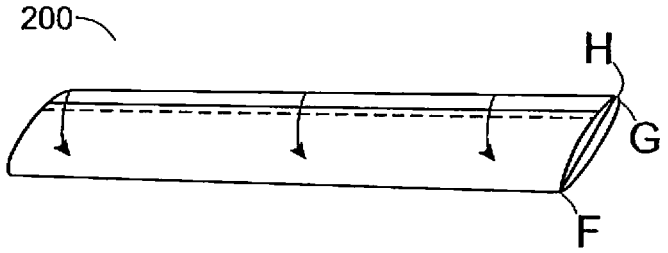
Figure 11F:
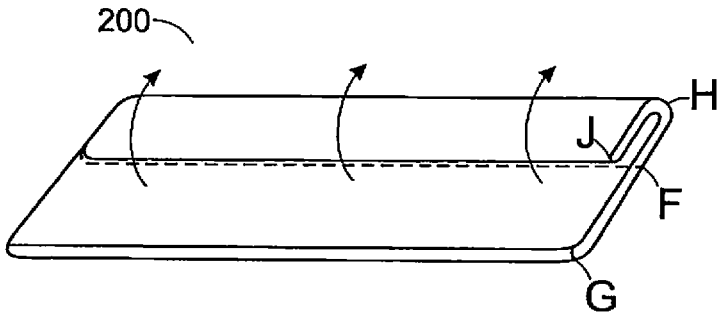
Figure 11G:
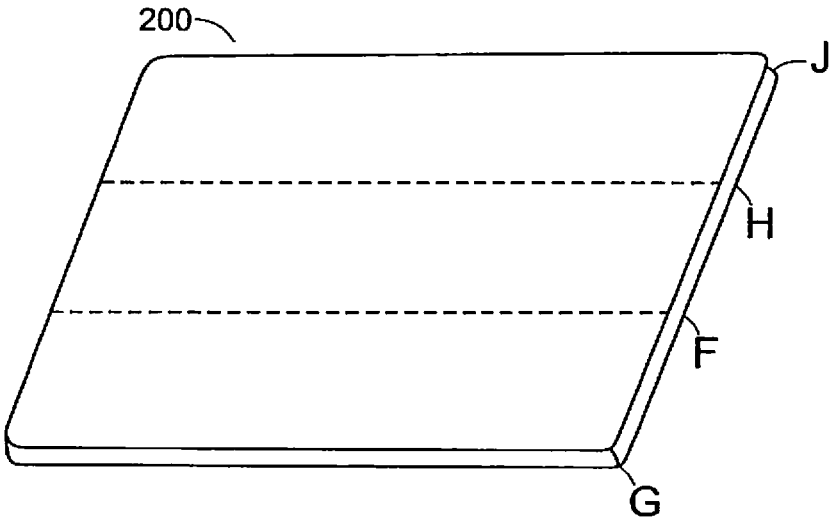

FIGS. 11*a-g* show the method of deploying a flexible encapsulator film workbag or bladder 200. Preferably, upon manufacture or storage, the bag will be folded such that the process of unfolding the bag 200 will comprise the following steps: first, placing edge A on the ground as in FIG. 11*a*, pass edge C over fold B as in FIG. 11*b*; then pass edge D over fold C as in FIG. 11*c*; then finally pass edge E over fold D as in FIG. 11*d*. Next, as seen in FIGS. 11*e* and 11*f*, lengthwise edge G is passed over fold F, and edge J is passed over fold H, so that the entire encapsulator film bag is laying flat on the ground as in FIG. 11*g*. Accordingly, the encapsulator film workbag then can be readily deployed within a set of adjustable poles, or incorporated in a skeletal frame structure.

Figure 12A:
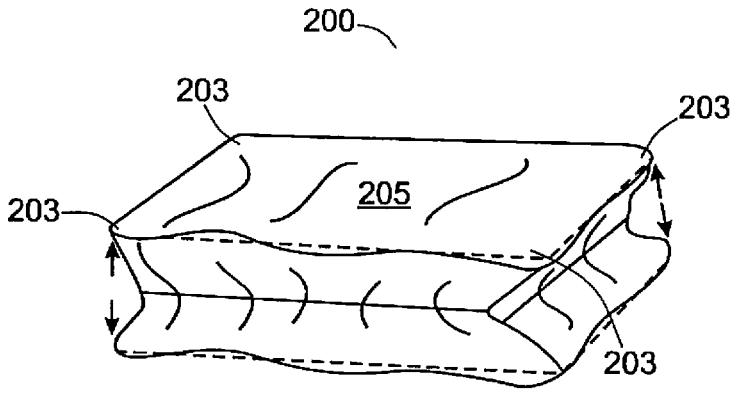
FIGS. 12*a-b* is a diagram showing the deployment of the apparatus of FIG. 9.
Figure 12B:
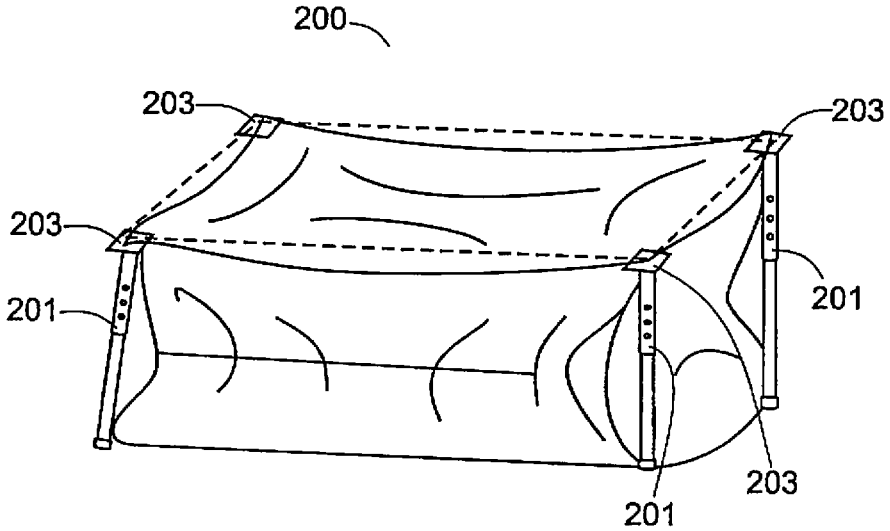

As seen in FIGS. 12*a* and 12*b*, the top 205 of the encapsulator film workbag is lifted, thus creating working and collection space within the bag 200 to be deployed in a work area. Adjustable height vertical legs 201 are used to press the upper corners 203 of the bag 200 against a ceiling and using friction hold the bag 200 in place in a work area. It is contemplated that suitable workbag containers will be fabricated from webs of thermoplastic film formed into gusseted bags having a seal at one end and an opening at the opposite end.

As noted above, it is contemplated that a variety of other means may be used to secure the bag 200 to the legs 201 besides friction directly on the bag itself, including having additional flaps or ties attached to the bag for engaging the legs 201, or rings or grommets installed in the bag for engaging the legs 201. It is contemplated that in certain embodiments, the frame mechanism utilized to deploy and hold open the workbag at the work-piece location also can be strings or line, taped, clipped or secured to edges of the workbag and then tied off at suitable secure positions effective for holding the workbag in place.

Figure 13A:
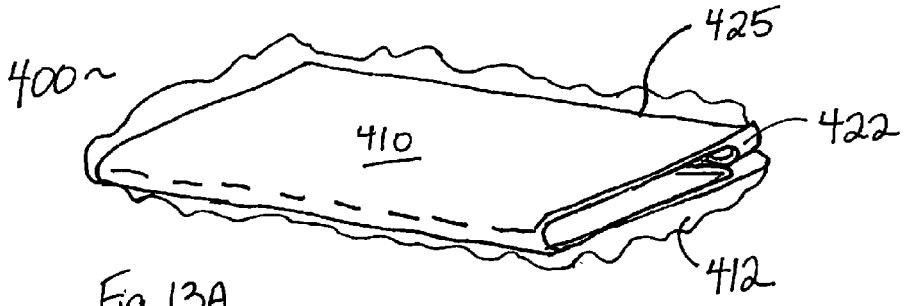
FIGS. 13A-13*c* depict deployment of a further embodiment of the subject design.
Figure 13B:
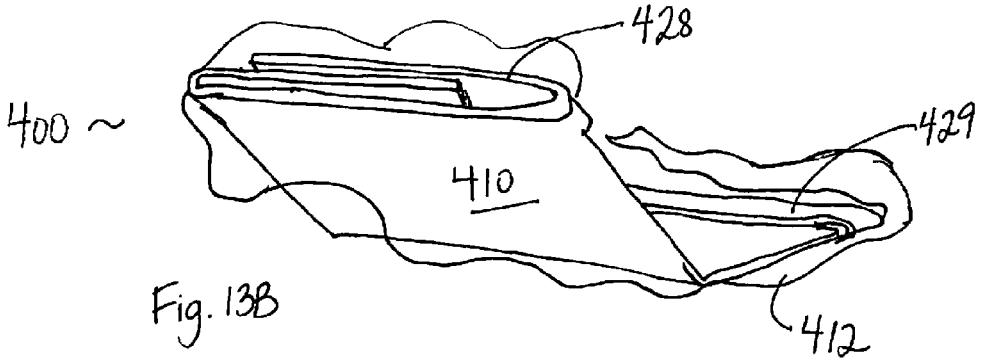
Figure 13C:
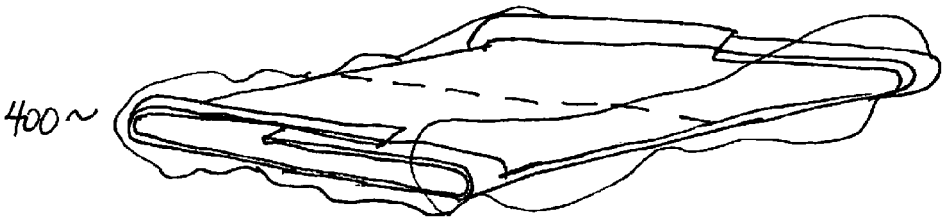

FIGS. 13*a*-13*c* depict deployment of a further embodiment 400 of the subject design wherein paperboard platform 410 is initially folded to contain an encapsulator workbag 412. By unfolding top edge 425 from bottom edge 429, the built-in posts 422, 424, 426 and 428 are revealed within the workbag 412. In some embodiments, posts can be included within the assembly and folded outward and upward in operation, or posts may be added separately.

Figure 14:
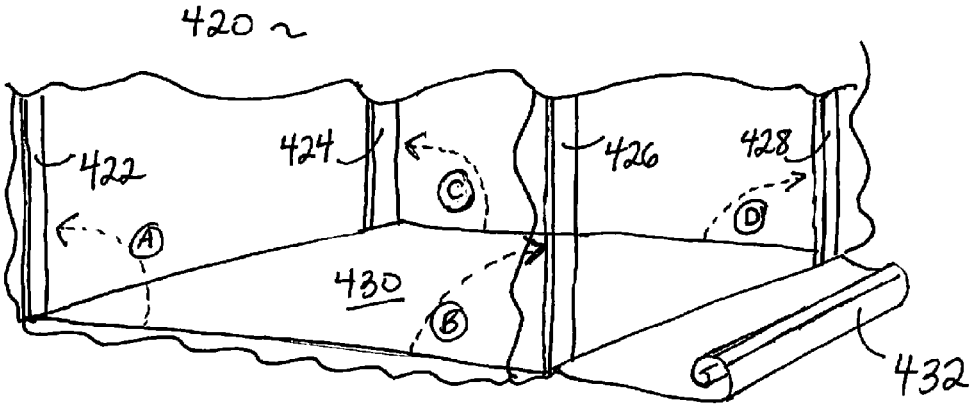
FIG. 14 is a perspective view of a portion of the alternative design seen in FIGS. 13A-C.

FIG. 14 is a perspective view of a portion of an alternative design 420 wherein paperboard platform 430 is deployed horizontally upon a floor and foldable legs 422, 424, 426 and 428 are raised with hinges to upright positions for holding the upper parts of the encapsulator workbag. In this view the workbag opening is to the right hand side where flap 432 can be seen.

Figure 15:
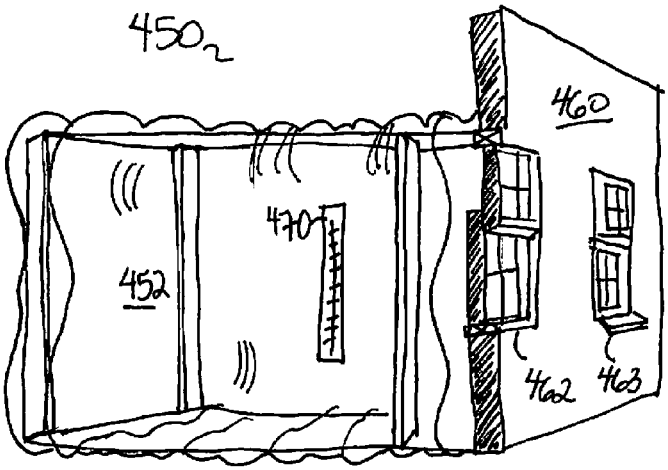
FIG. 15 is a perspective view of the alternative encapsulator system deployed at a worksite for removal of fenestrations.

FIG. 15 is a perspective view of the alternative encapsulator system 450 deployed at a worksite for removal of fenestrations. In this view, the encapsulator system 450 is fully deployed for removal or remediation of fenestrations 462, 463 in wall 460. In this embodiment, an access point is provided by a zipper 470 secured to film wall 452 with adhesive such as 3M Blue Painter's Tape.

Figure 16:
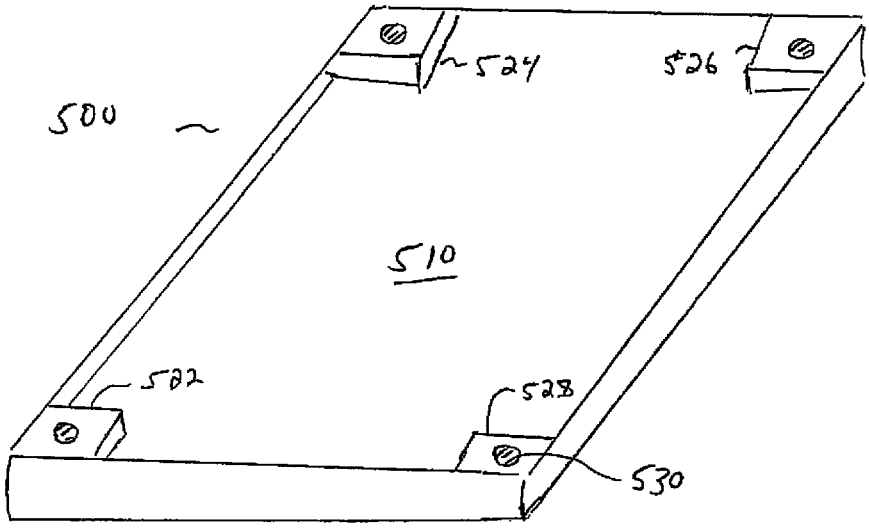
FIG. 16 is a perspective detail of a portion of an alternative embodiment of the encapsulator system.

FIG. 16 is a perspective view of encapsulator platform base 500 which in this example is approximately ⅜ in. thick corrugated paperboard 510. In this view are also seen four post boots 522, 524, 526 and 528 for subsequent erection of workbag bearing poles. Within each post boot is an aperture 530 for holding the posts. The post boots may be fashioned from paperboard or molded plastics as desired.

Figure 17:
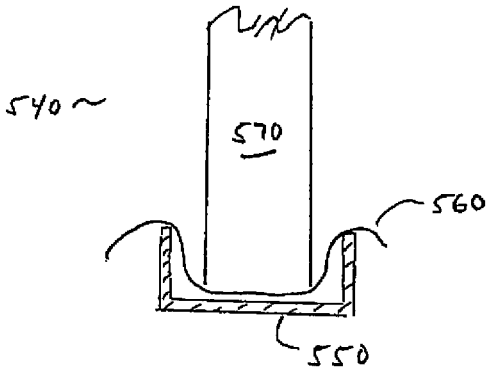
FIG. 17 is a cross-sectional detail of a portion of a pole boot useful in some embodiments of the subject design.

FIG. 17 is a cross-sectional detail of alternative embodiment 540, showing a portion of pole boot 550 useful in some embodiments of the subject design. In FIG. 17, a portion of workbag film 560 is shown in exaggerated detail, held within boot by the weight and friction provided by pole 570.

As noted above, the encapsulator film bag may be used without any separate structural frame, if the upper corners of the bag are securely attached to a ceiling by any means of attachment, including trussing with cord or line of sufficient length and strength to hold the encapsulator bag in position. In such case, the ceiling attachment and line act as the framing mechanism.

In a further embodiment, a corrugated containerboard (paperboard) platform of various sizes (e.g. 4×6, 6×6, or 10×6 ft) may be provided. It is preferably foldable at 2 ft increments and contains a 3 mil plastic workbag of matching dimensions and having four circular cardboard poles or similar rectangular cardboard posts that would fit inside circular cardboard footings attached to the platform pinching the bag into the receiver hole with the base of the circular pole. The cardboard platform is used outside the bag while the poles that fit inside the footings are inside the bag. Paperboard poles of circular tubing and having various fixed, adjustable or ready-to-cut lengths (e.g. 7-9 ft) may be provided in typical remediation applications.

The system framing members can be made from a wide range of materials and sizes. Most preferred will be adjustable metal members such as aluminum or steel poles and horizontal framing pieces. For other installations, PVC tubing and plumbing joints can be satisfactory. For simpler installations, even adjustable lumber with bolts and wing nuts can be utilized. Telescoping poles of varying lengths, using snap, screw or friction fittings are particularly useful in connection with the present system.

It is preferred that the flexible thermoplastic film container be made of a rugged, transparent thermoplastic sheet such as saran and similar sheet films of sufficient thickness and durability, of at least one mil with a preferred thickness of at least 2 mil to 20 mil or more, such that it can withstand any strains imposed by seams, storage, transport, as well as during intended use with the poles, frame or a worker therein, and will safely contain all necessary lead chips, particles, dust and contaminated debris. Thicknesses of 3 mil to 6 mil are preferred in many applications. Less than 2 mil sheets are not sufficiently resilient and sheets thicker than 6 mil become difficult to handle in ordinary applications. Preferred plastic films may also have electrostatic properties which facilitate attraction and adherence of dust particles thereto. The encapsulator workbags may additionally incorporate pressure sensitive adhesives for sealing around a work piece, or such sealing may be accomplished by sealing tape and related methods.

In a preferred embodiment of the subject system, the method and apparatus may be utilized as follows. The workbag can be installed on sheetrock, wallpaper, wallboard, tile, plaster or veneer surfaces and the like, however, it is not to be installed upon the window, door or casing that is to be removed. The selected surface is prepared until it is dry, clean, oil free and grease free.

The following procedure has been found to be suitable for area preparation. First, clear the work area, moving any objects that are in or around the intended work space such as furniture, art work, window treatments, door treatments, curtains, drapes etc. Close any closet and room doors whenever possible. Place the workbag and frame or adjustable poles in front of the intended work area. When using poles, carefully select spots on the ceiling and floor that are safe for adjustable pole use.

Before continuing with interior setup, prepare the exterior of the fenestration according to all applicable guidelines or standards. For example, to learn more about working safely with lead, see the EPA's Website at www.epa.gov/lead or HUD's Website at www.hud.gov/offices/lead.

The interior setup may be installed as follows. 1. Unfold the workbag with open its end facing the fenestration (window or door). 2. Position two front poles on opposite sides of the open end of the bag. 3. Measure the ceiling height and divide height in half to determine placement of poles on workbag. For example, for an 8 ft ceiling, attach poles 4 ft in from the sides of the workbag to achieve the proper amount of slack from floor to ceiling. 4. Adjustable poles should be outside of the bag, not inside. Attach the head of the adjustable poles over the outside of the bag, placing the head of the poles approximately 16 inches in from the edge of the open end of the bag, leaving approximately 12 inches of slack hanging loosely. 5. Extend one adjustable pole to the ceiling so the bag is taut and firmly lock in place. 6. Measure for 2nd pole placement by dividing the ceiling height in half. Again, attach head of pole. Spread the second pole accordingly to maximize the work area, then extend the adjustable pole to the ceiling and firmly lock in place.

To place the rear poles, measure the ceiling height and divide in half to determine the proper amount of slack to maximize your workspace. Attach the two back poles to the opposite corners of the rear of the workbag. Then extend one adjustable pole to the ceiling so the bag is taut and firmly lock in place. Finally, spread the last pole accordingly to maximize the work area, then extend the adjustable pole to the ceiling and firmly lock in place.

In preferred embodiments, a replaceable zipper is utilized to facilitate entry and exit from the deployed workbag. Select where the zippered opening location is intended and be sure the plastic is clean and the area is sufficient for the length of the zipper. Then peel the release paper from the back of the zipper at the top and press the zipper onto the plastic. Remove the paper as the zipper is pressed onto the plastic, keeping it as straight as possible. At the bottom of the zipper, separate the two sides of the zipper to be sure both pulls are free of the adhesive. The inside pull should not be stuck to the zipper. Carefully unzip the zipper completely and use the opening as a guide to cut the plastic thereby creating an entry to the interior of the workbag.

Now that the zipper is open and the plastic is cut, run your fingers up and down the plastic and the zipper to ensure a tight bond. If possible, allow a few minutes for the adhesive to set before zipping it back together.

Next, a worker enters the workbag and closes the zipper. Seal the slack of the workbag around the fenestration, (window or door) using painter's tape. Two inch tape minimum is recommended. Starting from the floor of the workbag, seal the open end of the workbag to the wall or edge of floor. Moving clockwise around the fenestration, be sure to seal the workbag above, below and on all sides to ensure an airtight seal between the edges of the workbag and the surface of the wall around the fenestration that is to be removed. Overlapping the corners of the interior slack, thereby creating "Hospital corners" is recommended. Begin work, remediation or renovation as usual.

Once all possibly contaminated materials have been removed and/or bagged, begin the takedown process. Mist and wipe the wall area around the seal of the open end of the workbag. Use caution as the workbag is slippery when wet. Mist and wet down the interior of the workbag where dust is visible. It is preferred to mist the work area while backing away towards the exit to avoid stepping on a wet plastic area. Before exiting the workbag, remove disposable shoe covers, disposable coveralls or anything that could be contaminated and leave the possibly contaminated items inside the workbag. Once all parties are safely outside of the workbag, close the zipper thereby sealing the contaminants within the workbag.

Make sure no one is standing in front of the sealed workbag while it is in use or during the takedown process. Collapse the workbag by first unlocking the adjustable rear poles. Lower and separate the adjustable poles from the rear of the workbag. The poles are lowered and removed while the sealed workbag remains in place taped around fenestration (window or door).

Make sure that the zipper is completely closed before beginning the next step. Grabbing the rear of the workbag, fold and roll it inward, pushing all air out of the workbag through the open fenestration, while rolling it into a ball towards the front poles. Place the semi-rolled workbag on the floor and unlock the front poles. Unlock, lower and separate the front poles from the workbag. The sealed workbag should remain in place taped around the fenestration (window or door). Pick up the semi-rolled workbag off of the floor and continue to roll and fold inward still pushing the air out of the workbag through the open fenestration, up to the wall. Once in front of the wall, gently remove the adhesive or painter's tape from around the fenestration (window or door) and fold tightly into a ball. Tape the roll with duct tape or seal in a heavy duty plastic trash bag. Dispose of the workbag containing contaminants properly.

The invention now being fully described, it will be apparent to one of ordinary skill in the art that many changes and modifications can be made thereto without departing from the spirit or scope of the invention as set forth herein.

The invention claimed is:

1. An encapsulating system for abating and mitigating contamination from lead-based dust, particles and/or chips in a construction repair, renovation or removal operation and minimizing exposure to lead-based hazardous materials, comprising:

a. A portable and adjustable framing mechanism adapted to surround a contaminated work-piece installed in a work-area and requiring remediation;

b. a flexible and durable plastic encapsulating container positioned within and supported by the framing mechanism, the container creating a working and collection space having at least one open-end for surrounding and sealing off the contaminated work piece from the interior of a work area, wherein the open-end of the container is adhered to the work-area and substantially surrounding the contaminated work-piece, enclosing and isolating the contaminated work-piece; a second seal for the open-end of the container to keep particles and dust therein before removing air from and collapsing the container and thereby containing hazardous lead-based materials during the construction repair, renovation or removal operation.

2. The encapsulating system as in claim 1, wherein the framing mechanism is an adjustable pole system having a plurality of height adjustable vertical legs, the frame legs configured to deploy and support the encapsulating container.

3. The encapsulating system as in claim 2, wherein the flexible plastic encapsulating container is positioned within and supported by the adjustable pole system, the container having the at least one open-end for surrounding and sealing off the contaminated work piece from the interior of the work site, wherein the open-end of the container is adhered to the work-area and substantially surrounds the contaminated work-piece, thereby enclosing and containing hazardous lead-based materials during the construction repair, renovation or removal operation.

4. The encapsulating system as in claim 3, wherein the flexible plastic encapsulating container is a thermoplastic film sheet of approximately 2 mil to 20 mil in thickness.

5. The encapsulating system as in claim 4, wherein the flexible plastic encapsulating container is a sheet of saran film.

6. The encapsulating system as in claim 2, further comprising at least one air-entry filter to facilitate maintenance of the flexible container shape during use and providing fresh air to a user deployed therein.

7. The encapsulating system as in claim 1, wherein the framing mechanism is an adjustable frame apparatus having a plurality of height adjustable vertical legs and a plurality of overhead horizontal frame members, the frame apparatus configured to deploy and support the encapsulating container.

8. The encapsulating system as in claim 1, wherein the framing mechanism is comprised of a truss line.

9. The encapsulating system as in claim 1, further comprising at least one entry/exit port separate from the end opening of the container and adapted to allow movement of an operator there through.

10. The encapsulating system as in claim 9 where the port is a zipper installed in a wall of the encapsulating container.

11. The encapsulating system as in claim 1, further comprising a pressure sensitive adhesive or tape means for opening, closing and maintaining a seal around a contaminated work piece.

12. The encapsulating system as in claim 1, further comprising at least one port for accommodating a filter device for dust-free removal of air to facilitate collapsing the flexible container when a remediation project is completed.

* * * * *